US007212775B2

(12) United States Patent
Kachi

(10) Patent No.: US 7,212,775 B2
(45) Date of Patent: May 1, 2007

(54) MAGNETIC FLUX IMAGE HEATING DEVICE WITH GUIDE HOLDING ENDLESS BELT

(75) Inventor: Masayoshi Kachi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 162 days.

(21) Appl. No.: 11/167,184

(22) Filed: Jun. 28, 2005

(65) Prior Publication Data

US 2005/0281595 A1 Dec. 22, 2005

(30) Foreign Application Priority Data

Jun. 30, 2004 (JP) ..... 2004-193163

(51) Int. Cl.
*G03G 15/20* (2006.01)

(52) U.S. Cl. ..... 399/329

(58) Field of Classification Search ..... 219/619; 399/328, 329, 330
See application file for complete search history.

(56) References Cited

U.S. PATENT DOCUMENTS

| | | | | |
|---|---|---|---|---|
| 6,625,417 | B1 | 9/2003 | Terada et al. | 399/328 |
| 6,678,498 | B2 | 1/2004 | Terada et al. | 399/328 |
| 6,733,943 | B2 * | 5/2004 | Finn et al. | 430/124 |
| 6,757,513 | B2 | 6/2004 | Terada et al. | 399/328 |
| 6,819,904 | B2 | 11/2004 | Terada et al. | 399/328 |
| 7,016,638 | B2 | 3/2006 | Ono et al. | 399/329 |
| 7,020,423 | B2 | 3/2006 | Ono et al. | 399/329 |
| 7,107,000 | B2 * | 9/2006 | Watanabe et al. | 399/328 |
| 2003/0152406 | A1 | 8/2003 | Terada et al. | 399/328 |
| 2003/0170055 | A1 | 9/2003 | Terada et al. | 399/328 |
| 2004/0081490 | A1 | 4/2004 | Terada et al. | 399/328 |
| 2005/0271433 | A1 | 12/2005 | Ono et al. | 399/329 |
| 2005/0281595 | A1 | 12/2005 | Kachi | 399/329 |

FOREIGN PATENT DOCUMENTS

| | | |
|---|---|---|
| JP | 2000-250338 | 9/2000 |
| JP | 2003-91186 | 3/2003 |

* cited by examiner

*Primary Examiner*—Hoang Ngo
(74) *Attorney, Agent, or Firm*—Fitzpatrick, Cella, Harper & Scinto

(57) ABSTRACT

In an image heating device for heating images on a recording member by heating a belt using an induction heating system, a belt guide for restricting the belt position is fixed to a belt part opposing a coil so as not to rotate the belt guide.

6 Claims, 6 Drawing Sheets

MAGNETIC FLUX IMAGE HEATING DEVICE WITH GUIDE HOLDING ENDLESS BELT

BACKGROUND OF THE INVENTION

1. Field of the Invention

The present invention relates to an image heating device for heating an image formed on a recording member by an electromagnetic induction heating system.

2. Description of the Related Art

Recently, in order to comply with demands for energy savings and heating time reduction, an electromagnetic induction heating fixing-device (fuser) has been developed and manufactured for mounting on an image forming apparatus.

In the electromagnetic induction heating system, by passing a high-frequency current through an exciting coil generating a variable magnetic field so as to produce a high-frequency magnetic field, a heating material (conductive member) is heated by an eddy current due to the magnetic field. In the electromagnetic induction heating fixing-device, a fixing material is directly heated using the induction current, so that a higher efficient fixing process is achieved in comparison with a conventional fixing method using a halogen lamp or a ceramic heater.

Recently, in order to prevent an increase in coil temperature due to increased speed, a heating method has also been developed in that the exciting coil is arranged outside the fixing member so as to heat the fixing member from the outside.

In order to reduce the temperature rise time, there is proposed an electromagnetic induction heating fixing-device that uses an endless belt member having a conductive layer as a fixing member, a belt guide member is arranged over substantially the entire internal region of the belt member, and an induction heating unit is arranged outside the belt member so as to heat the belt member from the outside by the electromagnetic induction (see Japanese Patent Laid-Open No. 2003-91186, for example). Also, in order to reduce the temperature rise time, there is proposed an electromagnetic induction heating fixing-device using an endless belt member having a conductive layer as a fixing member and an induction heating unit is arranged outside the belt member so as to heat the belt member from the outside by the electromagnetic induction, a heating roller is arranged inside the belt so as to heat the heating roller by the induction heating unit arranged outside the belt (see Japanese Patent Laid-Open No. 2000-250338, for example).

However, in Japanese Patent Laid-Open No. 2003-91186, since the belt guide member is fixed so as not to rotate, the traveling performance of the belt member is unstable when functioning as the fixing member. Also, since the position opposing the exciting coil flux center corresponding to the maximum exothermic part among opposing parts between the exciting coil and the belt is not in contact with the guide member, the distance between the belt and the coil in the maximum exothermic part varies so as to make the heating of the belt member unstable, resulting in gloss unevenness and fuseing failure due to temperature unevenness within the surface of the belt member. In Japanese Patent Laid-Open No. 2000-250338, since a member for suspending the belt is the rolling roller, the surface of the roller being out of contact with the belt member and not facing the belt member is rotated, so that the heat of the belt is captured by the roller every time the roller comes contact with the belt, resulting in elongation of the temperature rise time.

SUMMARY OF THE INVENTION

An image heating device according to the present invention includes a coil generating a magnetic flux; a rotatable endless belt having a conductive layer generating heat, by the action of the magnetic flux, to heating images on a recording member; and a guide member facing an inner surface of the belt and fixed in position so as not to rotate, for supporting and guiding the belt with a predetermined tension, wherein the guide member is arranged to oppose the coil with the belt therebetween and is extending from one end of the belt toward the other end along the surface of the belt so as to be circumferentially wound at a position substantially opposing the center in the width direction of a coil bundle bundled so that an electric current flowing through the coil is directed along the widthwise direction of the belt among coils extending toward the both ends of the belt.

Further features and advantages of the present invention will become apparent from the following description of exemplary embodiments with reference to the attached drawings.

DESCRIPTION OF THE EMBODIMENTS

First Embodiment

A first embodiment of the present invention will be described below.

(1) Image-Forming Apparatus Example

Figure 1:
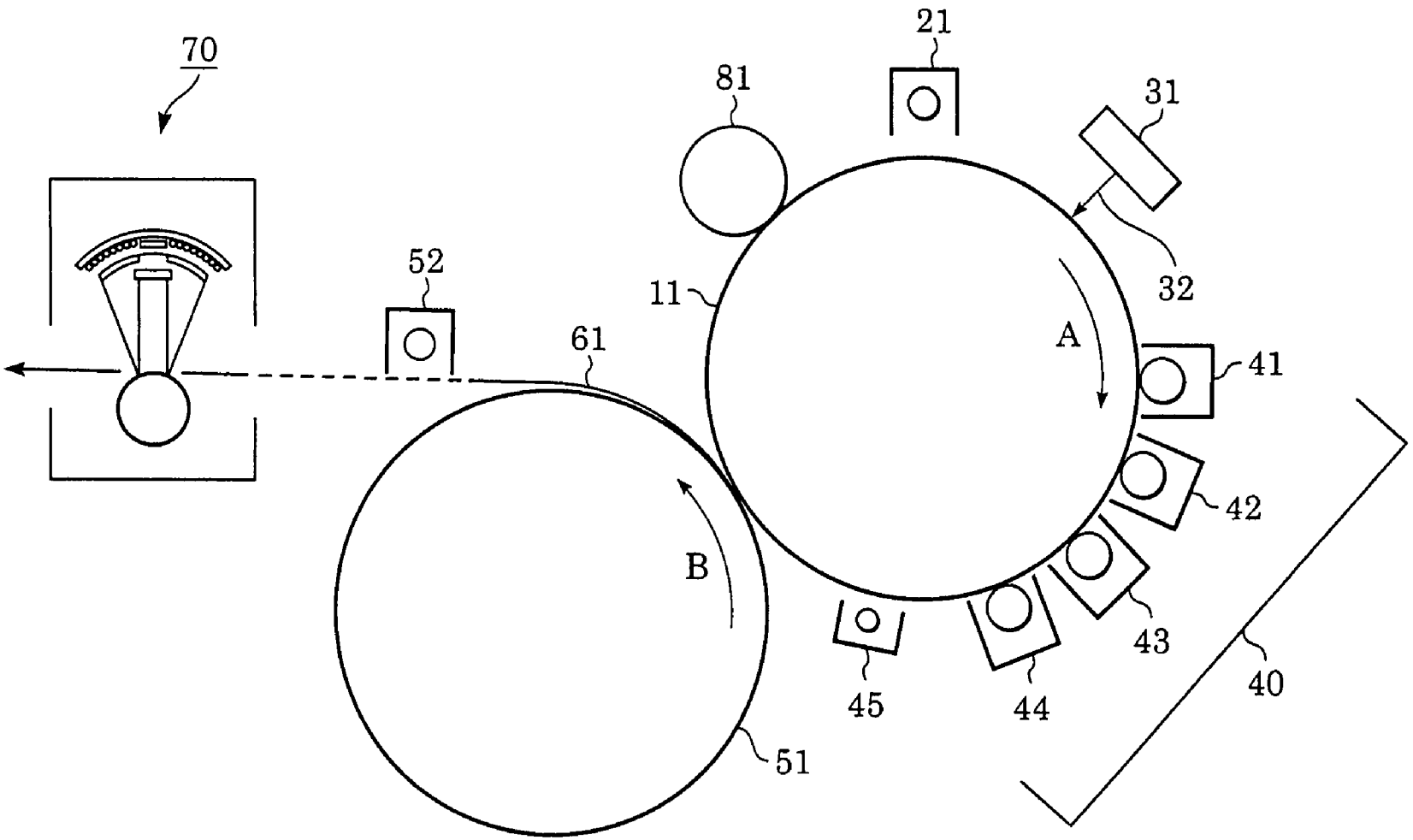
FIG. 1 is a schematic structural drawing of an example of an image-forming apparatus.

FIG. 1 is a schematic structural drawing of an image-forming apparatus according to the first embodiment. The image-forming apparatus according to the first embodiment is an electrophotographic full-color printer.

An electrophotographic photosensitive drum (referred to as a photosensitive member below) 11 is composed of a cylinder (substrate) made of aluminum or nickel and a photosensitive material layer, such as an OPC (organic photo conductor) and amorphous Si, formed on the cylinder, and is clockwise rotated at a predetermined processing speed in arrow A direction.

The photosensitive member 11 is exposed with image exposure light 32 by an exposure device 31 after being charged by a primary charger 21 during the rotation. The image exposure light 32 corresponds to a yellow ingredient pattern of the full-color images. The exposure device 31 according to the embodiment is an LED exposure device, and the photosensitive member 11 is irradiated with the image exposure light emitted from an LED and passing through an image formation lens (not shown). By the attenuation of the surface potential of the exposed portion of the photosensitive member 11 corresponding to an image signal level, an electrostatic latent image corresponding to the image exposure pattern is formed on the surface of the photosensitive member 11. The exposure device 31 may also use a semiconductor laser element in addition to the LED.

The electrostatic latent image formed as described above is developed by a color developer unit 40. The color developer unit 40 is composed of four-color developer units that are a yellow developer unit 41, a magenta developer unit 42, a cyan developer unit 43, and a black developer unit 44, and is detachably arranged to the photosensitive member 11. As a developing order, the yellow developer unit 41 first comes in contact with the photosensitive member 11 for development so as to form a yellow toner image on the photosensitive member 11 while the other developer units are spaced from the photosensitive member 11. In each developer unit, by applying a developing bias voltage of a DC voltage superposed on an AC voltage, the electrostatic latent image formed on the photosensitive member 11 is reversed and developed.

Then, by applying a voltage of an AC voltage superposed on a DC voltage to the toner image with a charger 45, the tribo of toner (electric charges per unit weight of toner) is optimized.

The yellow toner image on the photosensitive member 11 is transferred to a transfer member 61 fed from a medium tray (not shown) and wound counterclockwise around a transfer drum 51 rotating in arrow B direction so as to electrostaticaly adhere thereto. After the toner image is transferred to the transfer member 61, the surface of the photosensitive member 11 is cleaned by removing residual toner with a cleaning unit 81.

Performing the series of image-forming processes of charging, exposing, developing, transferring, and cleaning described above consequently in the order of a magenta ingredient pattern, a cyan ingredient pattern, and a black ingredient pattern of a full-color image, forms an unfixed full-color toner image on the surface of the transfer member 61 by sequentially superposing toner images of yellow, magenta, cyan, and black, four patterns in total, on the same surface of the transfer member 61 on the transfer drum 51.

The transfer member 61 having the entire toner images transferred thereon is separated from the transfer drum 51 as a result of charging by a separation charger 52 and the curvature of the transfer drum 51. Then, the transfer member 61 is conveyed to a fixing device 70 for fixing images, and is then discharged outside the image-forming apparatus as a member having full-color images formed thereon.

(2) The Fixing Device 70

The structure of the fixing device 70 will be described as an image heating device. The fixing device 70, using an endless belt member having a conductive layer as a fixing member, employs an electromagnetic induction heating system in that an induction heating unit is arranged outside the belt member so as to heat the belt member from the outside by electromagnetic induction.

Figure 2:
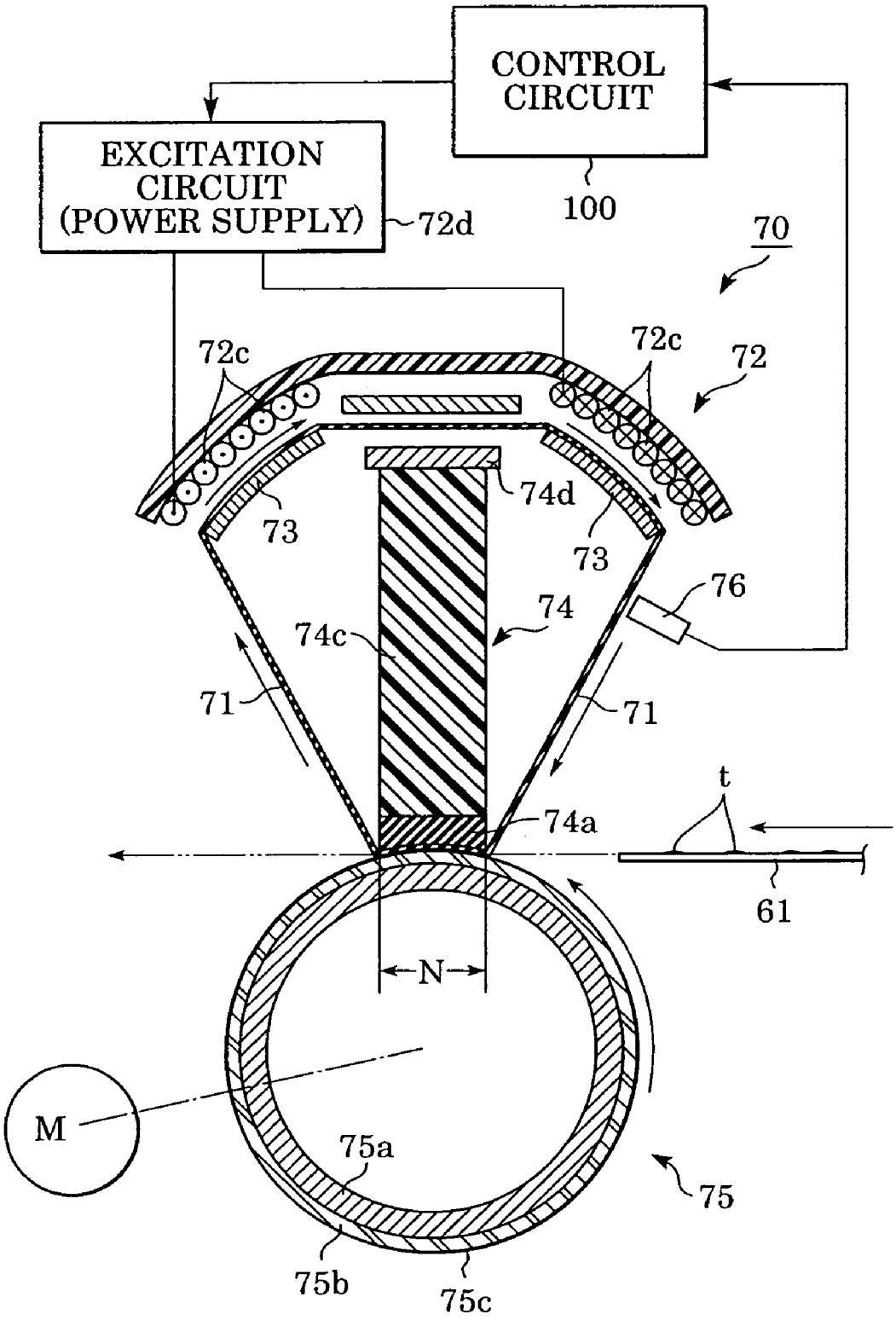
FIG. 2 is an enlarged schematic cross-sectional drawing of a fixing device according to a first embodiment.

FIG. 2 is an enlarged cross-sectional schematic view of the fixing device 70.

The fixing device 70 is provided with an endless belt member (referred to as a belt below) 71 having a conductive layer as a fixing member, an electromagnetic induction heating unit 72 arranged so as to oppose the external circumferential surface of the belt 71, a magnetic metallic belt guide (belt guide member) 73 arranged in contact with the internal surface of the belt 71 so as to oppose the electromagnetic induction heating unit 72, a nip component part 74 arranged inside the belt 71 so as to form a fixing nip N, a pressure roller 75 arranged so as to oppose the external circumferential surface of belt 71 as a pressure member forming the fixing nip N by pushing against the belt 71 in a direction of the nip component part 74, and a non-contact temperature sensor 76 for measuring the surface temperature of the belt 71.

The pressure roller 75 is counterclockwise rotated in the direction of the arrow at a predetermined peripheral speed by a drive motor M. According to the first embodiment, the peripheral speed is 180 mm/S.

According to the embodiment, upon turning on a power supply or a copy button, the pressure roller 75 is rotated in a counter-clockwise direction as shown by the arrow so as to clockwise drive the belt 71 to follow the pressure roller 75 by a frictional force to the belt 71 at the fixing nip N along surfaces of the nip component part 74 and the belt guide 73.

Simultaneously, by applying an electric current to an exciting coil 72*c* of the electromagnetic induction heating unit 72 from an exciting circuit 72*d* as a power supply, the belt 71 and the belt guide (magnetic member) 73 are directly induction-heated. The belt surface temperature is measured with the temperature sensor 76, and the detected temperature information is entered to a control circuit 100. The control circuit 100 controls the electric power supply to the exciting coil 72*c* from the exciting circuit 72*d* so as to maintain the detected temperature information entered from the temperature sensor 76 at a predetermined fixing temperature. That is, the temperature of the belt 71 is raised to a predetermined fixing temperature and is maintained at the temperature.

When the temperature of the belt 71 becomes the predetermined fixing temperature, the apparatus is ready to operate, so that the transfer member 61 having unfixed toner images t carried thereon is led to the fixing device 70 from an image-forming mechanism. Then, the transfer member 61 enters the fixing nip N between the belt 71 and the pressure roller 75 so as to be clamped and conveyed. During the clamped conveying, the transfer member 61 and the unfixed toner images t are heated by the belt heat as well as pressed by the pressure of the fixing nip N, so that the unfixed toner images t are thermally fixed on the surface of the transfer member 61.

Next, the above-mentioned structural components will be described in detail.

1) The Belt 71

Figure 3:
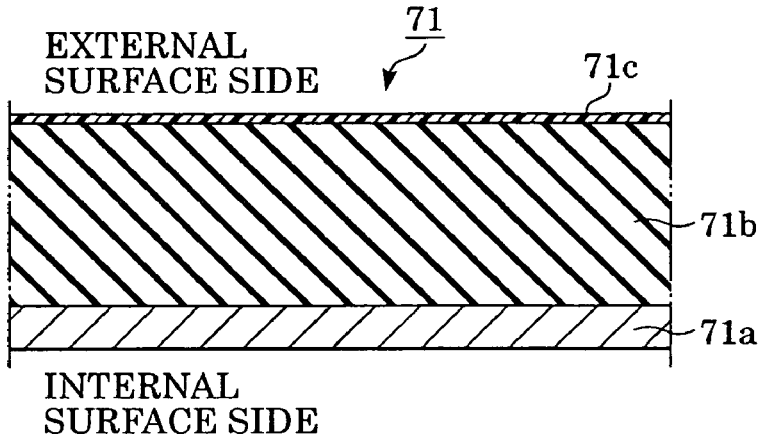
FIG. 3 is a schematic layer structural drawing of a belt.

The endless belt 71 with a diameter of 35 mm, as shown in the schematic layer structural drawing of FIG. 3, has a three-layered structure of a conductive layer 71*a* made of electrically good conductive nickel, an elastic layer 71*b* made of silicon rubber and covering the conductive layer 71*a*, and a separation layer 71*c* made of a fluororesin and covering the elastic layer 71*b*.

By applying an alternating magnetic flux to the conductive layer 71*a*, an eddy current is produced in the conductive layer 71*a* so as to heat it. This heat is transferred to the fixing nip N via the elastic layer 71*b* and the separation layer 71*c* so as to heat the fixing nip N, thereby heating a transfer member 61 as it passes through the fixing nip N and the unfixed toner images t for image fixing.

In addition to nickel, the conductive layer 71*a* may be a metal, a metallic compound, and an organic conductor, which are good electric conductors with a resistance of $10^{-5}$ to $10^{-10}$ Ωm. More preferably, iron, cobalt, or their compounds with high magnetic permeability and magnetism may also be used.

A thickness t of the conductive layer 71*a* satisfies:

$$t < 503\sqrt{\frac{\rho}{f\mu}}$$

where ρ denotes a specific resistance; f a frequency of the exciting circuit; and μ a permeability of the conductive layer.

That is, the thickness of the conductive layer 71*a* is thinner than the absorption depth of an electromagnetic wave. If the thickness of the conductive layer 71*a* is increased, almost the entire magnetic flux is absorbed in the conductive layer 71*a*, so that the magnetic flux does not pervade the belt guide 73. According to the embodiment, the thickness is 30 μm.

The elastic layer 71*b* may preferably have a hardness of 10 to 50° (JIS-A, Japanese Industrial Standard) and a thickness of about 100 to 500 μm. According to the first embodiment, the hardness is 30° (JIS-A) and the thickness is 150 μm.

The separation layer 71*c* may preferably be made of a high-releasing fluororesin (PFA, PTFE, and FEP, for example) sheet with a thickness of about 20 μm. According to the first embodiment, coated PTFE with a thickness of 10 μm is used.

2) The Electromagnetic Induction Heating Unit 72

The electromagnetic induction heating unit 72 is arranged along the external circumferential surface of the belt 71 so as to heat the conductive layer 71*a* and the belt guide 73.

Figure 5:
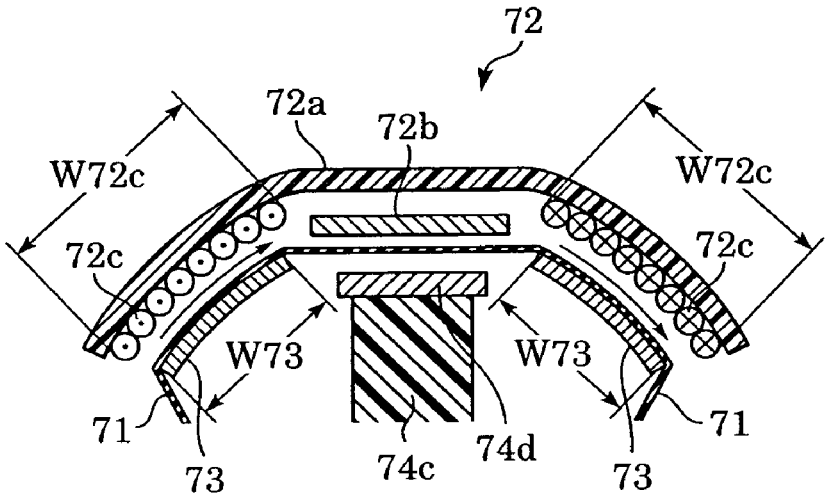
FIG. 5 is an explanatory view illustrating the relationship between the belt guide width and the width of an exciting coil bundle.

As shown in FIG. 5, the electromagnetic induction heating unit 72 is composed of a magnetic material core 72*b* made of ferrite and supported on a pedestal 72*a*, the exciting coil 72*c* wound around the magnetic material core 72*b* so as to make eight rounds thereof, and the exciting circuit 72*d* for supplying an AC current with a frequency of 30 to 100 KHz to the exciting coil 72*c*. The exciting coil 72*c* is wound along the surface of the belt 71 and extended in parallel to the rotating shaft of the belt 71, and circumferentially wound by being folded at both ends of the belt.

The pedestal 72*a* has non-magnetic heat endurance and uses a heat resistant resin. The magnetic material core 72*b* may be a single core block, or a plurality of core blocks may also be continuously arranged. The exciting coil 72*c* must generate enough magnetic flux for heating, so the resistance has to be low and the impedance must be high. According to the embodiment, a Litz wire for high frequency with a wire diameter ϕ2 of 3 mm bundled with copper wires with a diameter ϕ1 of 0.2 mm is used. The exciting coil 72*c* is wound in the rotating direction (circumferential direction) of the belt so that wires come in contact with each other to form coil bundles with widths of W72*c* and W72*c* in the circumferential direction of the belt (see FIG. 5). The coil bundles are arranged along a predetermined direction intersecting the rotational direction of the belt member. The exciting coil 72*c* generates a magnetic flux by the AC current supplied from the exciting circuit 72*d*, and the magnetic flux in turn produces an eddy current in the conductive layer 71*a* of the belt 71 and the belt guide 73. The eddy current produces heat due to the resistance of the conductive layer 71*a* so as to heat the belt 71.

3) The Belt Guide 73

Figure 4:
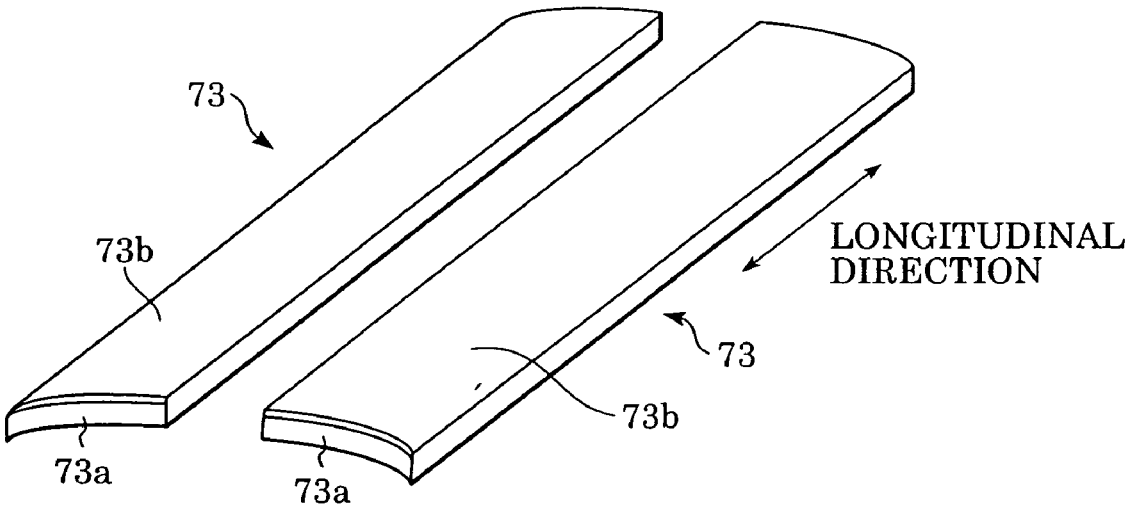
FIG. 4 is an external perspective view showing a longitudinal shape of a belt guide.

FIG. 4 is an external perspective view of the longitudinal shape of the belt guide (restricting member) 73 as positioning and restricting means for maintaining the distance between the part of the belt 71 opposing the magnetic flux generating means and the magnetic flux generating means. The belt guide 73 is arranged to be in contact with the internal surface of the belt 71 at a position opposing the exciting coil 72*c*. The belt guide 73 is composed of a magnetic metallic layer (magnetic metallic material) 73*a* made of iron with a thickness of 0.15 mm and a width of 15 mm, and a low frictional layer 73*b* with a thickness of 8 μm arranged on the surface in contact with the internal surface of the belt 71 and made of PTFE coat for reducing the friction of the sliding surface. The belt guide 73 is arranged so that the gap between the external circumferential surface of the belt 71 and the exciting coil 72*c* is to be 1 mm along the entire region. That is, the belt guide 73 maintains constant the gap between the external circumferential surface of the belt 71 and the exciting coil 72*c* in the heating region. Also, the exciting coil 72*c* and the belt guide 73 are fixed to the side plate of the fixing device, respectively. By fixing them to the common member in such a manner, the distance between both components is maintained constant. The exciting coil 72*c* and the belt guide 73 do not necessarily need to be secured to a common member as long as members interposing between the coil member and the belt member are fixed together. The magnetic flux generated in the exciting coil 72*c* so as to pass through the belt 71 passes through the low frictional layer 73*b* so as to produce an eddy current in the magnetic metallic layer 73*a*. By this eddy current, the magnetic metallic layer 73*a* is heated for heating the belt 71. The exciting coil 72*c* forms a pair of the bundles having widths of W72*c* and W72*c* with a space at the winding center of the exciting coil 72*c* (the space having the magnetic material core 72*b* arranged therein) therebetween. The belt guide 73 is arranged to oppose the center of the coil bundles W72*c* extending to intersect the belt rotational direction so as to be fixed in contact with the center. That is, the belt guide member is arranged so as to maintain the distance between the coil bundles and the region including at least the maximum heating part of the belt member constant, preventing the temperature unevenness.

The magnetic metallic layer 73*a* may also be a metal such as cobalt or nickel and their compounds. The thickness of the magnetic metallic layer 73*a* preferably satisfies:

$$d < 503\sqrt{\frac{\rho}{f\mu}}$$

where d denotes a skin depth; ρ a specific resistance; f a frequency of the exciting circuit; and μ a permeability of the conductive layer.

If the thickness of the magnetic metallic layer 73*a* is larger than the skin depth d, the belt guide 73 is not heated enough by the magnetic flux passing through the belt 71, so that the temperature rise of the belt 71 is hindered. Furthermore, it is preferable that the sum of the thickness of the conductive layer of the belt 71*a* and that of the magnetic metallic layer of the guide 73*a* be larger than the skin depth d while the thickness of the conductive layer of the belt 71*a* alone be smaller than the skin depth d.

Also, as shown in FIG. 5, it is preferable that the width W73 of the belt guide 73 in the belt circumferential direction be less than the whole width W72*c* of the exciting coil bundle. If the width W73 of the belt guide 73 in the belt circumferential direction is larger than the width W72*c* of the exciting coil bundle, sufficient power cannot be obtained in the belt guide 73, so that the temperature rise of the belt 71 is hindered. The width of the coil bundle means a length in the adjacent direction of the Litz wires which are formed by bundling coil wires and arranged by being folded so as to be adjacent to each other. According to the embodiment, the exciting coil forms a pair of the bundles with a space at the winding center of the exciting coil (the space having the magnetic material core 72*b* arranged therein) therebetween; alternatively, the coil may form one bundle by embedding the winding center of the coil. In this case, the coils W72*c* and W72*c* are assumed to be one bundle coil in the center of the coil bundle in that the flowing directions of the electric current agree with each other among the coils extending in the perpendicular direction to the belt rotational direction. That is, even when the coil is wound so as to embed the winding center of the coil, it is assumed that there are two bundles of a bundle heading toward back from rear and a bundle heading toward rear from back. The eddy current flows along the coil bundle so as to oppose thereto, and the vicinity of the opposing part of the coil bundle corresponds to the maximum heating part.

It is preferable for the low frictional layer 73*b* to have a thickness of about 5 to 50 μm. If it is less than 5 μm, the layer may be worn away so that the internal surface of the belt 71 comes in contact with the magnetic metallic layer 73*a*. If it is larger than 50 μm, the efficiency of heat transfer between the magnetic metallic layer 73*a* and the belt 71 may be deteriorated. According to the embodiment, the belt guide member is provided with the magnetic metallic layer for generating heat. However, the present invention is not limited to this and the metallic layer may be formed of only a resin with low heat capacity.

4) The Nip Component Part 74

Figure 6:
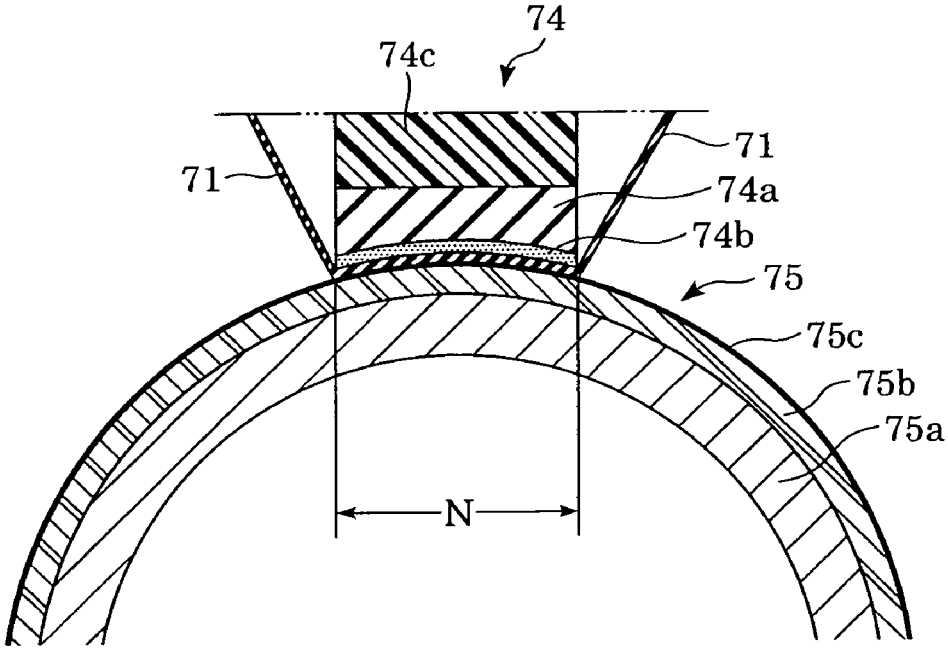
FIG. 6 is an enlarged view of a fixing nip component part.

The nip component part 74, as shown in the enlarged view of FIG. 6, includes a pressure applying member 74*a* shaped along the circumferential surface of the pressure roller 75, a low frictional layer 74*b* made of a PTFE coat layer arranged on the surface of the pressure applying member 74*a*, and a holder 74*c* of a heat-resistant resin.

According to the embodiment, the pressure applying member 74*a* is made of silicon rubber having a width of 8 mm, a thickness of 2 mm, and a rubber hardness of 20° (JIS-A); and the low frictional layer 74*b* has a thickness of 10 μm. There is provided a magnetic body 74*d* arranged to oppose the electromagnetic induction heating unit 72 of the resin holder 74*c* at a position not in contact with the belt.

The pressure applying member 74*a* is pressed into contact with the pressure roller 75 with the belt 71 therebetween and shaped to follow the circumferential surface of the pressure roller 75 so as to have an enough nip width. According to the embodiment, the nip width is 8 mm. The pressure applying member 74*a* is not limited to the silicon rubber, so that it may also use a metallic material or a heat-resistant resin material. The low frictional layer 74*b* reduces the friction to the internal circumferential surface of the belt 71. The low frictional layer 74*b* is not limited to the PTFE, so that other fluorocarbon resins may also be used. The magnetic body 74*d* is made of a magnetic metallic material, such as iron, cobalt, and nickel, and accumulates the magnetic flux passing through the belt 71 and the belt guide 73.

5) The Pressure Roller 75

The pressure roller 75 is composed of a metallic core grid 75*a*, an elastic layer 75*b* made of a sponge or silicon rubber as an intermediate layer, and a separation layer 75*c* made of a fluorocarbon resin as an outer layer. According to the embodiment, the hollow iron core grid 75*a* has a thickness of 2 mm, the sponge rubber elastic layer 75*b* has a thickness of 1 mm, and the separation layer 75*c* is a PFA tube with a thickness of 30 μm. In addition, the structure of the pressure roller 75 may be appropriately changed; however, if the caloric capacity is excessively increased, it causes delay of the rise time.

6) The Temperature Sensor 76

The temperature sensor 76 is for measuring the surface temperature of the belt 71 and is not in contact with the belt 71, and uses an infrared sensor for measuring the temperature by sensing the amount of the infrared ray irradiated from the belt 71. The control circuit 100 controls the electric power supply from the exciting circuit 72*d* to the exciting coil 72*c* so as to maintain a desired surface temperature of the belt 71 corresponding to the output from the temperature sensor 76.

7) The Performance Test of the Fixing Device 70

Using the fixing device 70 structured as described above, the measurement of a period for time for the belt surface temperature to rise (rise time) from room temperature (25° C.) to 180° C., the measurement of the belt temperature distribution with a thermo viewer, and the evaluation of images during the operation were performed. In the image evaluation, the evenness of gloss was evaluated in that using a 60° gloss meter, when the gloss difference is within 5 in the same recording medium, the level was to be OK.

Figure 7:
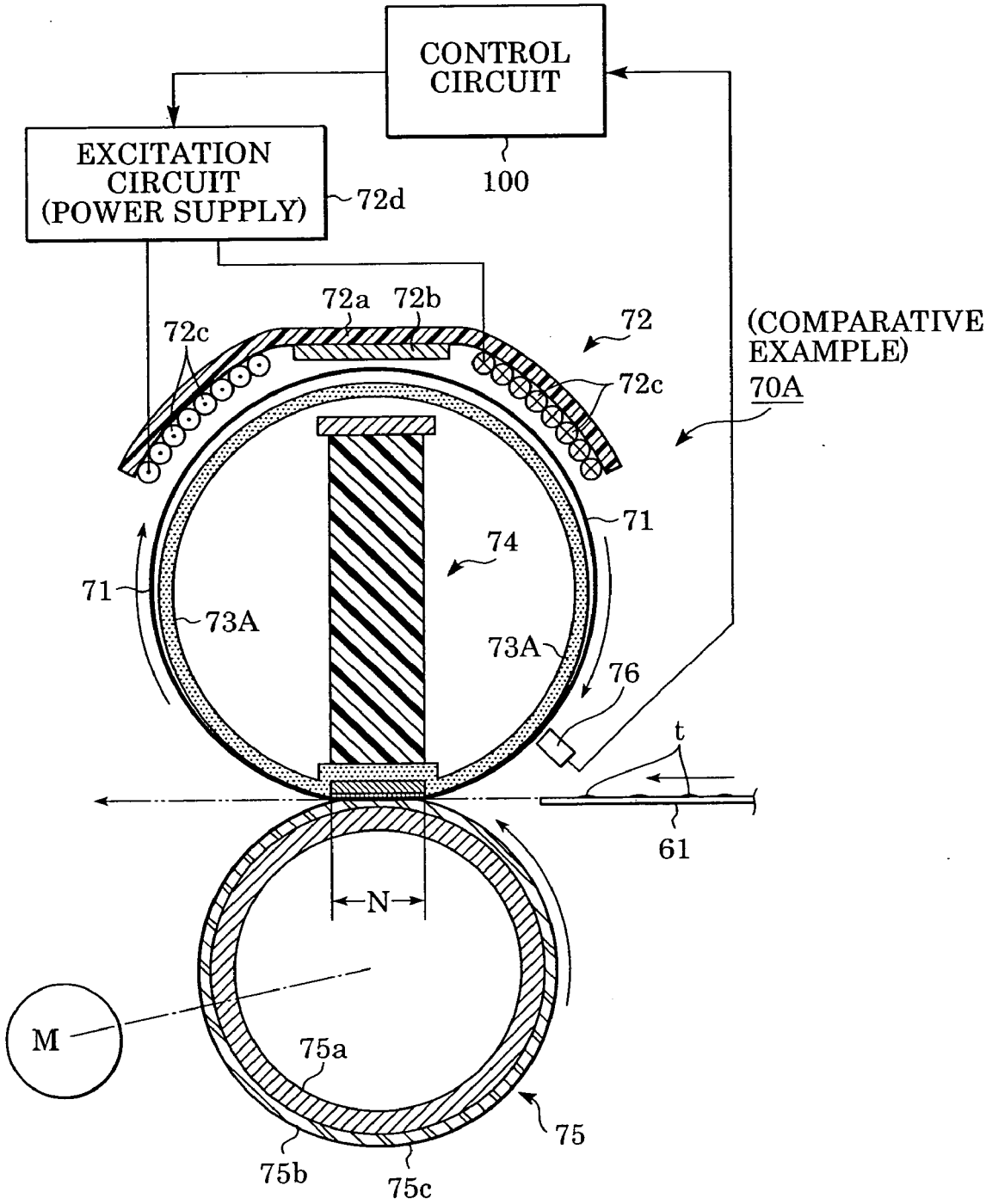
FIG. 7 is an enlarged schematic cross-sectional drawing of a fixing device of a comparative example.

As a comparative example, as shown in FIG. 7, a fixing device 70A used a belt guide 73A made of a non-magnetic resin and arranged by not restricting the position among belt members opposing the coil.

Figure 8:
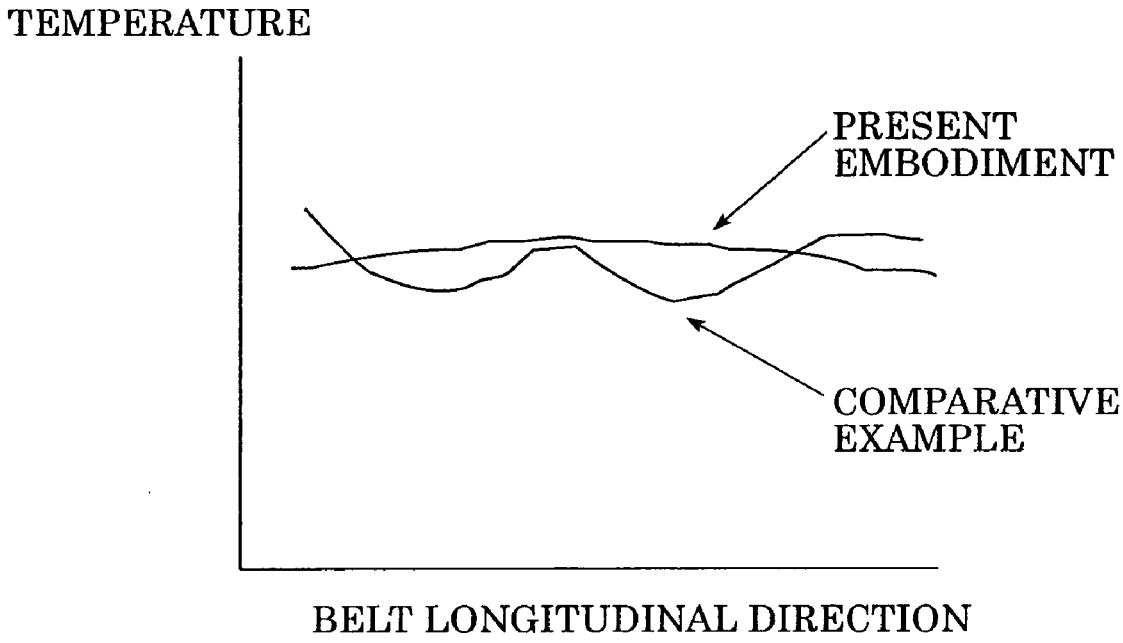
FIG. 8 is a comparative diagram between the fixing device according to the first embodiment and the fixing device of the comparative example.

Results of the temperature rise time and the image evaluation from both the fixing device 70 and the comparative example are shown in Table 1, and the comparison between both the examples of the temperature distribution of the belt 71 is shown in FIG. 8.

TABLE 1

Table 1: the rise time and the image evaluation of the embodiment and the comparative example

| | Time to 180° C. | Image evaluation |
|---|---|---|
| Comparative example | 10 seconds | No good |
| The embodiment | 7 seconds | Excellent |

From Table 1 and FIG. 8, it has been confirmed that the temperature rise time of the fixing device 70 according to the present embodiment of the invention can be reduced. Moreover, the temperature of the belt 71 has been uniformly distributed, and excellent images can be obtained without gloss unevenness within the surface.

As is understood from these results, by arranging the belt guide 73 located in contact with the internal surface of the belt 71 only at a position opposing the exciting coil 72*c*, the caloric capacity of the belt guide 73 and the temperature unevenness of the belt 71 can be reduced, so that a fixing device capable of reducing the rise time as well as obtaining excellent images without gloss unevenness can be provided.

Second Embodiment

A second embodiment according to the present invention will be described below.

Figure 9:
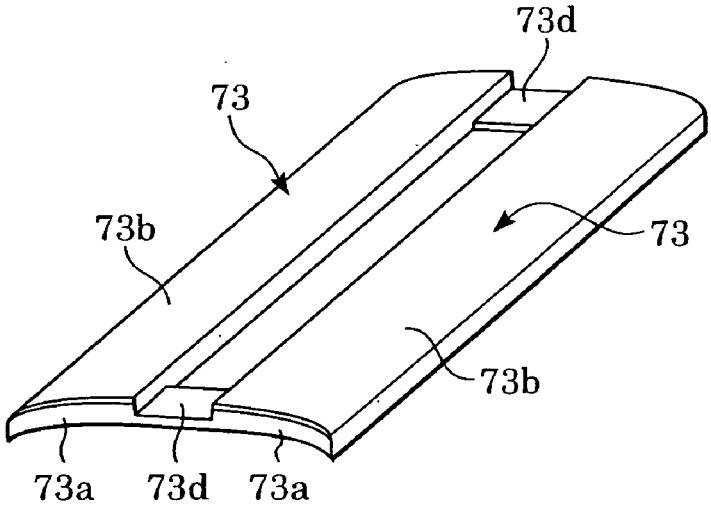
FIG. 9 is an external perspective view showing a longitudinal shape of a belt guide in a fixing device according to a second embodiment.

According to the embodiment, the shape of the belt guide 73 used in the first embodiment is changed. FIG. 9 shows the belt guide 73 according to the second embodiment. The shape of this belt guide 73 is changed from the guide used in the first embodiment, and two belt guides 73 and 73 are constructed by connecting both ends of magnetic metallic layers 73*a* and 73*a*, each having a thickness of 0.15 mm, together with magnetic metallic plates 73*d* and 73*d*, each having the same material as those of the magnetic metallic layers 73*a* and 73*a*, a thickness of 0.1 mm, and a longitudinal width of 5 mm, respectively. That is, the belt guide is integrally structured so as to straddle the winding center of the coil corresponding to the wound shape of the coil, to which the belt guide opposes. These magnetic metallic plates 73*d* and 73*d* do not come into contact with the belt 71 directly. Using the magnetic metallic plate with this shape, an eddy current generated in parallel with the winding direction of the coil forms a closed circuit and flows therethrough, so that the caloric power is increased, enabling the belt guide to be heated faster. By such a manner, although the caloric capacity is slightly increased, the eddy current is liable to flow through the belt guide, so that the belt guide can be heated faster.

In this structure, when the period of time for the belt surface temperature to rise from the room temperature (25° C.) to 180° C. was measured, it was 5 seconds. It is understood that this structure enables the temperature rise time to be further reduced.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims.

This application claims priority from Japanese Patent Application No. 2004-193163 filed Jun. 30, 2004, which is hereby incorporated by reference herein.

What is claimed is:

1. An image heating device comprising:

a coil generating a magnetic flux;

a rotatable endless belt for heating images on a recording member, said rotatable endless belt comprising a conductive layer generating heat by action of the magnetic flux; and a guide member facing an inner surface of said endless belt and fixed in position so as not to rotate, said guide member for supporting and guiding the belt with a predetermined tension, wherein said guide member is arranged to oppose said coil with said rotatable endless belt therebetween, said guide member at a position substantially opposing a center in a widthwise direction of a coil bundle, said coil bundle being bundled along a direction perpendicular to the rotational direction of said endless belt, and electric currents flowing through bundled coils being directed identically to each other.

2. The device according to claim 1, wherein the width of said guide member in the rotational direction of said rotatable endless belt is smaller than a width of said coil bundle in the rotational direction of said rotatable endless belt.

3. The device according to claim 1, wherein said guide member includes a heat generating layer for generating heat by action of the magnetic flux.

4. The device according to claim 3, wherein a thickness of the heat generating layer is smaller than a skin depth.

5. The device according to claim 1, wherein a thickness of the conductive layer of said rotatable endless belt is smaller than a skin depth.

6. The device according to claim 1, wherein a sum of a thickness of said rotatable endless belt and a thickness of the conductive layer generating heat is larger than a skin depth.

* * * * *

UNITED STATES PATENT AND TRADEMARK OFFICE

CERTIFICATE OF CORRECTION

PATENT NO. : 7,212,775 B2
APPLICATION NO. : 11/167184
DATED : May 1, 2007
INVENTOR(S) : Masayoshi Kachi It is certified that error appears in the above-identified patent and that said Letters Patent is hereby corrected as shown below:

COLUMN 1
Line 60, “fuseing” should read --fusing--

COLUMN 4
Line 17, “mm/S.” should read --mm/s.--.

COLUMN 7
Line 59, “an enough” should read --enough--.

Signed and Sealed this

Twenty-fifth Day of March, 2008

JON W. DUDAS
*Director of the United States Patent and Trademark Office*